United States Patent [19]

Easter

[11] Patent Number: 4,927,017

[45] Date of Patent: May 22, 1990

[54] PROTECTIVE COVERING FOR VIDEO CAMERA OR THE LIKE

[76] Inventor: Michael D. Easter, 840 J. St., Penrose, Colo. 81240

[21] Appl. No.: 412,843

[22] Filed: Sep. 26, 1989

[51] Int. Cl.[5] ..... B65D 85/38

[52] U.S. Cl. ..... 206/316.2

[58] Field of Search ..... 206/316.2

[56] References Cited

U.S. PATENT DOCUMENTS

| | | | |
|---|---|---|---|
| 1,535,312 | 4/1925 | Hosking | 206/316.2 X |
| 4,176,701 | 12/1979 | Welgan | 206/316.2 |
| 4,232,808 | 11/1980 | Gray | 206/316.2 X |
| 4,751,950 | 6/1988 | Bock | 206/316.2 |

FOREIGN PATENT DOCUMENTS

| | | | |
|---|---|---|---|
| 2061691 | 6/1972 | Fed. Rep. of Germany | 206/316.2 |
| 2226721 | 12/1973 | Fed. Rep. of Germany | 206/316.2 |

*Primary Examiner*—William Price

*Attorney, Agent, or Firm*—Klaas & Law

[57] ABSTRACT

A cover apparatus for protecting a video camera from dust and moisture while being used comprising a shield made of resilient, flexible material and having a length and width for being positioned over and along the upper portion of the camera in a bent semi-circular position therealong and supported thereby with a circular visor portion extending forwardly beyond the front end of the lens tube to shield it. A bag made of flexible collapsible and expandable cloth-like material provides a compartment of sufficient size to receive and entirely surround the video camera and shield.

11 Claims, 3 Drawing Sheets

PROTECTIVE COVERING FOR VIDEO CAMERA OR THE LIKE

This invention relates to a protective covering system for a video camera-recording device.

The protective covering system of the present invention is adapted for use in bad weather conditions to protect the video camera during use and also when not in use.

This application is generally related to my prior U.S. applications, Ser. No. 142,193 filed Jan. 11, 1988, for WRAPAROUND COVER FOR GUNS DURING FIELD USE, now U.S. Pat. No. 4,860,479 and U.S. Ser. No. 155,232 filed Feb. 12, 1988, for PROTECTIVE COVER FOR OPTICAL INSTRUMENTS DURING FIELD USE, now U.S. Pat. No. 4,865,191.

The applicant is aware of various patents for protective coverings for guns, such as Bogg, Jr. U.S. Pat. No. 2,364,340, Steen U.S. Pat. No. 2,932,334, Kolpin U.S. Pat. No. 2,872,960, Brelsford U.S. Pat. No. 2,599,689; for skis such as Champenois, Jr. U.S. Pat. No. 4,055,287; DeVera U.S. Pat. No. 4,674,787; for binoculars and cameras such as Gray U.S. Pat. No. 4,232,808, Bock U.S. Pat. No. 4,751,950, Wilgan U.S. Pat. No. 4,176,701.

At the present time, relatively small size portable video camera-recording (cam-corder) devices have become very popular for personal use by the general public and also, for professional use. Such camera devices have mechanism for recording video signals on 8 millimeter or other size video cassette film which is removably mounted in a cassette compartment in the camera. Such cameras have a main housing for enclosing the operating mechanism, a cassette compartment, and audio and visual recording apparatus. The housing also supports a lens tube, a viewing tube, a microphone, and a control mechanism panel including an on-off switch. The cam-corder devices are of a size and weight such as to enable the camera to be held by hand and a hand strap is usually provided on the housing for that purpose. A shoulder or neck strap may also be provided for carrying the camera. Many larger size professional cameras have the same general construction and arrangement as the personal camcorder devices.

The cam-corder devices are used to produce personal home or professional video movies for a wide variety of events including many outdoor events which may take place under a variety of environmental conditions including rain, sun, snow, wind, etc. The main objective of this invention is to provide a collapsible flexible protective covering system enabling the cam-corder devices to be stored, transported and used while being generally protected from the elements.

In general, the present invention comprises a shield and support member having a semi-circular cross-sectional configuration, which is mounted on the upper portion of a video camera, and a collapsible weatherproof, duffelbag-type member which is mounted around the shield and support member and the video camera. The present invention provides a cover apparatus for a video camera comprising a shield means made of resilient flexible material and having a length and width for being positioned over and along the upper portion of a video camera in a bent semi-circular position therealong and supported thereby with a semi-circular visor portion extending forwardly from the main housing beyond the front end of the lens tube a sufficient distance to shield the front end of the lens tube; a bag means made of flexible collapsible and expandable cloth-like material for providing a compartment of sufficient size to receive and entirely surround the video camera and the shield means; a relatively large size openable and closable access opening means at the front end portion of the bag means for enabling insertion into and removal of the camera from the compartment and being positionable in an open position whereat the lens tube is operable to record video signals and being positionable in a closed position to limit access of moisture and dust or the like; a relatively small size operable and closable access opening means at a rear end or side wall portion of the bag means for receiving the rear end portion of the viewing tube in an open position during operation of the camera and for covering the rear end portion and of the viewing tube in a closed position; and an openable and closable hand access opening means along one side portion of the bag means for enabling insertion of the hand of the camera operator and actuating of the camera controls during operation of the camera in an open position and for covering the camera controls during operation and during storage.

BRIEF DESCRIPTION OF THE DRAWINGS

Presently preferred and illustrative embodiments of the invention are shown in the accompanying drawings wherein.

DETAILED DESCRIPTION OF THE INVENTION

Figure 3:
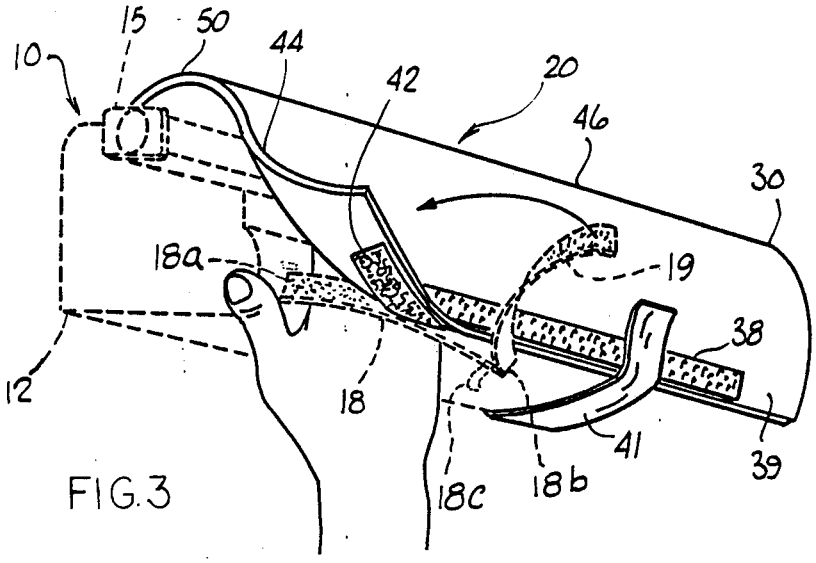
FIG. 3 is a perspective view of a protective shield member mounted on a video camera.
Figure 4:
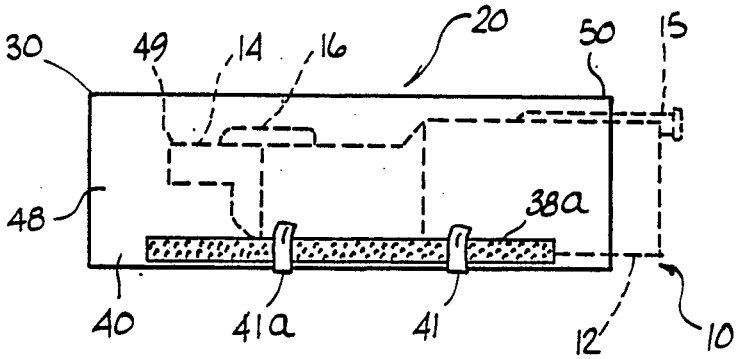
FIG. 4 is a side elevational view of the protective hood member in association with a video camera.
Figure 7:
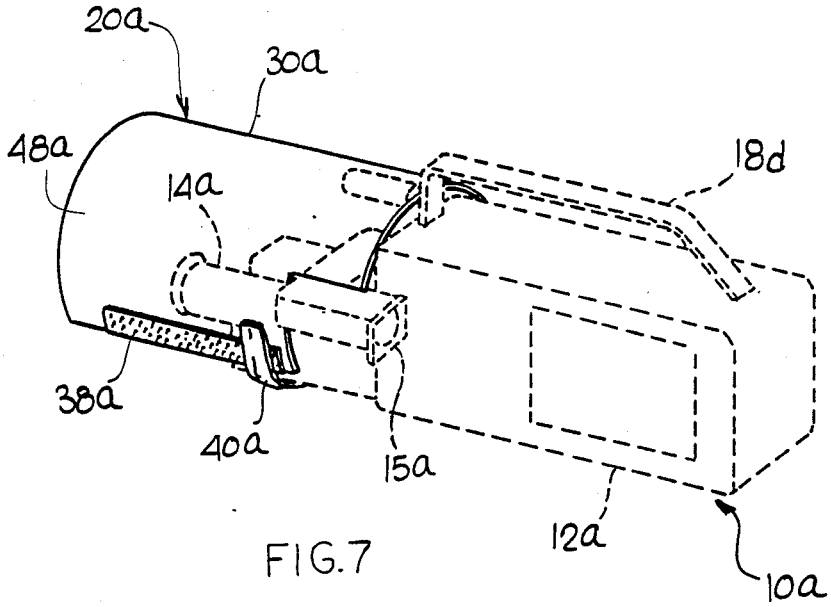
FIG. 7 is another perspective view of the camera and protective hood member of FIG. 7.

As shown in FIGS. 3, 4 and 7, the present invention is adapted for use with conventional video camera recording (cam-corder) devices 10, 10*a* (shown by dotted lines) comprising a main housing 12, 12*a*, a lens tube 14, 14*a*, a viewing tube 15, 15*a*, a microphone 16, 16*a*, a shoulder strap 17, an adjustable length hand strap having a portion 18 and an overlapping portion 19 with adjustable Velcro hook and loop connection devices therebetween. The end 18*a* of hand strap portion 18 is fixedly attached to the camera and the other end 18*b* slidably passes under a U-shape bracket 18*c* attached to the camera. The location of these basic components may vary from one cam-corder to another cam-corder.

In general, the covering apparatus comprises shield and support means 20 for mounting on the video camera to provide a shield and viewing tunnel over and above and extending forwardly of the lens tube and the microphone, and a bag means 22 made of flexible collapsible water resistance cloth-like material for and surrounding the shield and support means and the camera.

Figure 5:
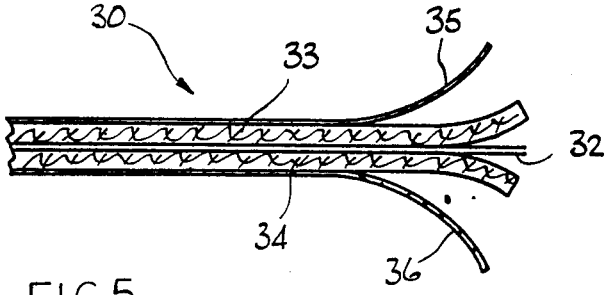
FIG. 5 is an enlarged cross-sectional view of a wall portion of the shield member.

As shown in FIGS. 3–5, the shield and support means 20 comprises an elongated covering shield member 30 having a semi-circular cross-sectional configuration mounted on the camera. The illustrative shield member is made from a rectangular sheet of normally flat resilient flexible semi-rigid plastic material which is capable of being resiliently formed into a semi-circular configuration and generally conforming to the contour of the camera. The rectangular sheet of material has a length sufficient to extend over a majoral portion of the camera housing and a substantial distance beyond the forward end of the lens tube 14. It has a width sufficient to cover the top and side portions of the camera. As shown in FIG. 5, in the illustrative embodiment, the sheet of material is a laminate comprising a central core portion 32 made of flexible, relatively thin (e.g., 0.020 inch) plastic sheet material, such as polystyrene, inner layers 33, 34 of foam material such as polyurethane, and outer water resistant cloth-like layers 35, 36 made of nylon fabric material.

Elongated Velcro fastening strips **38, 38*a* are mounted along each outer side of edge portions 39, 40 of the shield member 30 and at least one transverse Velcro fastening strap 41, 41*a* extends across the bottom of the camera for taut fastening engagement with the strips 38, 38*a*. The Velcro material on the inner side of the camera hand strap portion 19 may be fastened to adjacent strip 38 and the Velcro material on the outer side of camera hand strap portion 18 may be fastened to a Velcro strip 42 mounted along the inside of edge portion 39**.

In the mounted position, the shield member 30 has side wall portions 44, 45 and an intermediate connection portion 46. A visor-like front end portion 48 extends in cantilever fashion a substantial distance beyond the front end portion 49 of lens tube 14. The rear end portion 50 terminates forwardly of the rear end of the viewing tube 15. As shown in FIG. 3, the hand of the camera operator may be inserted beneath the side edge portion of the shield member to reach the camera operating mechanism.

Figure 1:
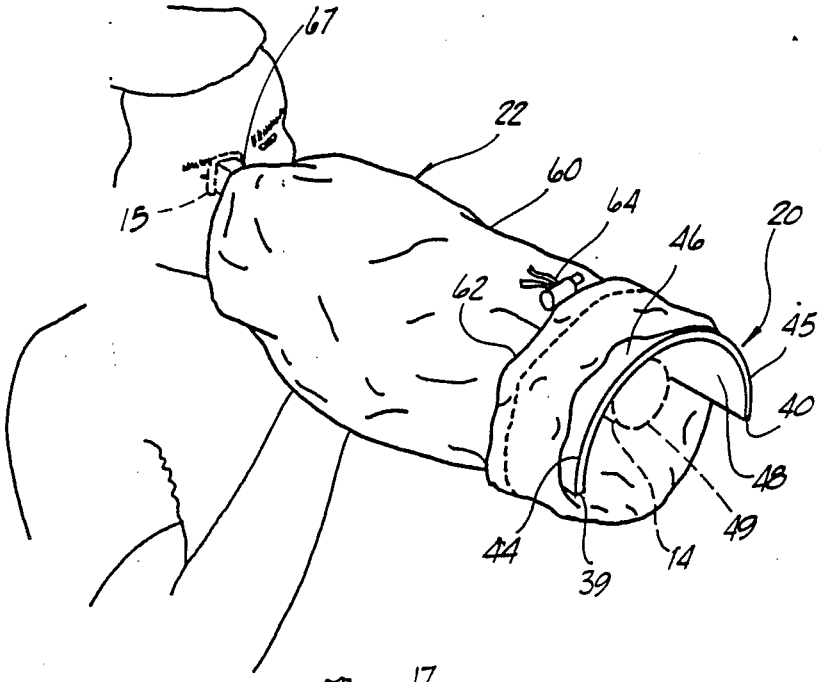
FIG. 1 is an illustrative perspective view of the use of a protective cover system of the present invention in an open operating position with one type of a small size video camera.
Figure 2:
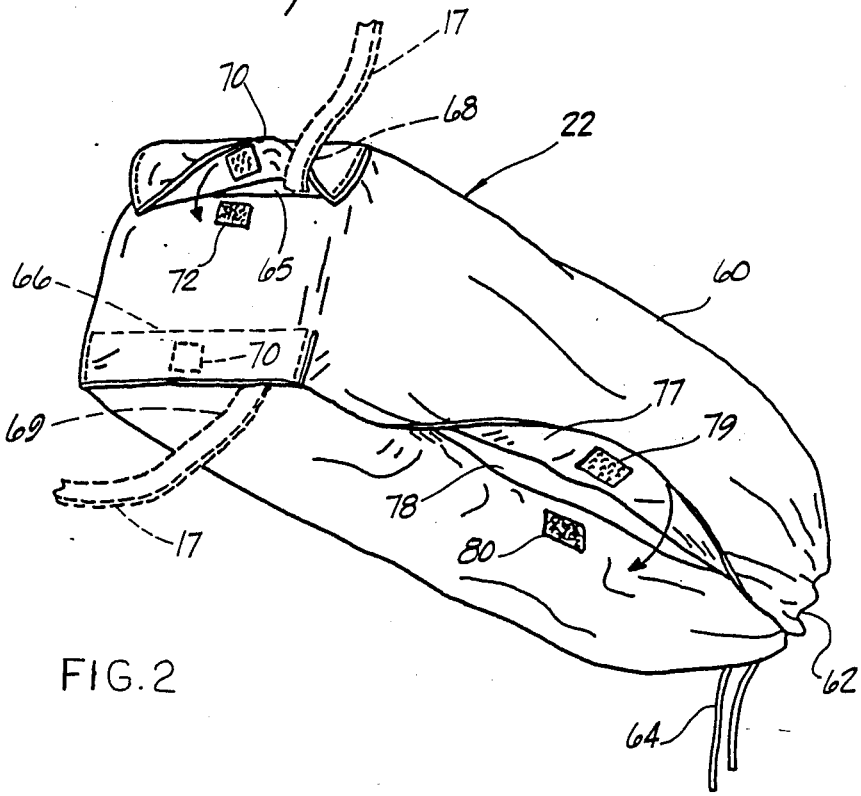
FIG. 2 is another illustrative perspective view of the protective cover system of FIG. 1.

As shown in FIGS. 1 and 2, the bag means 22, comprises a bag member 60 made of flexible water-resistant cloth-like material with a front end opening 62 having a draw string means 64 enabling opening and closing. One or more rear end openings 65, 66 may be provided for the rear end portion 67, and camera carrying strap end portions 68, 69. Flap portions 70, 72 and Velcro fastening strips 74, 76 are provided to cover and uncover openings 65, 66. A side flap portion 77 covers a side opening 78 to enable insertion of the operator's hand for operating the camera. Velcro fastening strips 79, 80 are provided for flap portion 77.

In the camera operating position shown in FIG. 1, the front end portion of the bag member is opened and may be rearwardly folded around the front end portion of the visor. The front end portions of the lens tube 14 and the microphone are located rearwardly of the front end portion of the visor within the bag opening to receive audio and video signals.

Figure 6:
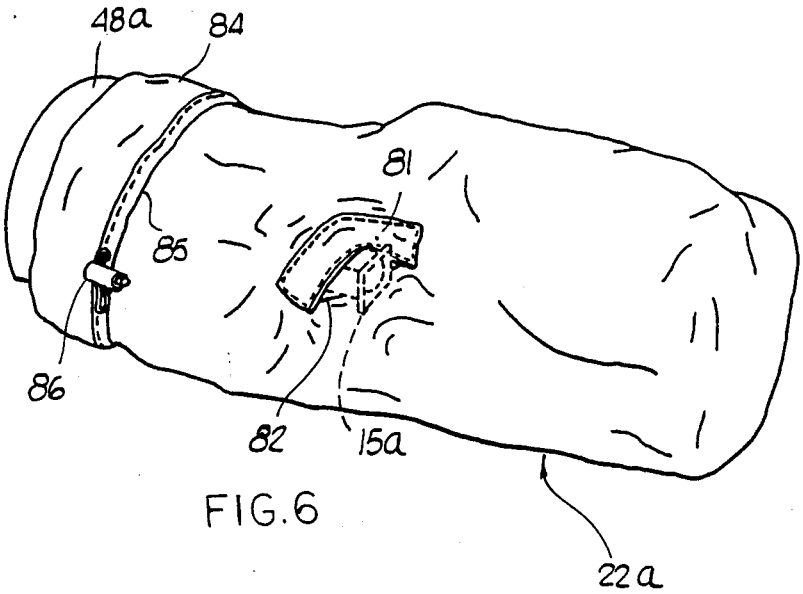
FIG. 6 is an illustrative perspective view of an alternative embodiment for use with another type of camera.

FIGS. 6 and 7 show an alternative embodiment for a full-size VHS camera having the viewing tube **15*a* mounted on the side of the camera. The hood member 30*a* is mounted on the forward portion of the camera in front of a carrying handle 18*d* by a Velcro strip 38*a* and strap 40*a* so that a front end portion 48*a* extends forwardly beyond the front end portions of the lens tube 14*a* and microphone 16*a*. A flap portion 81 is associated with a viewing tube opening 82. A hand opening and associated flap (not shown) are provided along the bottom of the bag member as previously described to enable placement of the operator's hand in association with a hand strap 18, 19 (not shown) as previously described. The hand strap has Velcro portions as previously described which are connectable to Velcro strips on the shield member as previously described. The front end portion 84 of the bag member has an opening 85 and a drawstring 86**. The bag member and the shield member may be separately mounted on the camera as shown or may be attached to one another as a unit. The bag member and the shield member may be made of other materials which provide the same functions.

Thus, the present invention provides a cover apparatus for a video camera comprising a shield means made of resilient flexible semi-rigid material and having a length and width for being positioned over and along the upper portion of a video camera in a bent semi-circular position therealong and supported thereby with a semi-circular visor portion extending forwardly from the main housing beyond the front end of the lens tube a sufficient distance to shield the front end of the lens tube; a bag means made of flexible collapsible and expandable cloth-like material for providing a compartment of sufficient size to receive and entirely surround the video camera and said shield means; a relatively large size openable and closable access opening means at the front end portion of said bag means for enabling insertion into and removal of the camera from said compartment and being positionable in an open position whereat the lens tube is operable to record video signals and being positionable in a closed position to limit access of moisture; a relatively small size operable and closable access opening means at a rear end portion of said bag means for receiving the rear end portion of the viewing tube in an open position during operation of the camera and for covering the rear end portion and of the viewing tube in a closed position; and an openable and closable hand access opening means along one side portion of said bag means for enabling insertion of the hand of the camera operator and actuating of the camera controls during operation of the camera in an open position and for covering the camera controls during operation and during storage.

While illustrative and presently preferred embodiments have been disclosed herein, it is intended that alternative embodiments be included within the scope of the appended claims except insofar as limited by prior art.

What is claimed is:

1. A cover for a video camera or the like, the camera having a main camera housing a lens tube, a microphone, a viewing tube, a hand strap with Velcro fastening devices, and a shoulder strap and comprising:

a shield means for mounting on the camera in a fixed mounting position thereon with a forward portion extending forwardly beyond the forward end of the lens tube a sufficient distance to provide a shield against moisture in the atmosphere and blocking of wind from the microphone;

fastening strap means mounted on said shield means for holding said shield means on the camera housing in the shielding position;

a flexible cloth-like bag means for providing a cavity therewithin of sufficient size and shape to receive and enclose the camera and said shield means; and an openable and closeable audio and visual signal receiving opening means in a front end portion of said bag means and being located adjacent said forward portion of said shield means for enabling operation of the camera in an open position and for closing the bag means in a storage position.

2. The invention as defined in claim 1 and wherein said shield means being separate from said bag means and being separately mountable on said camera.

3. The invention as defined in claims 1 or 2 and wherein said shield means being made of a normally flat sheet of flexible resilient semi-rigid plastic material which is resiliently deformable into a semi-cylindrical tube-like configuration.

4. The invention as defined in claim 1 and wherein said viewing opening means comprising an opening at the front end of said bag means and an associated drawstring means for selective opening and closing of said opening.

5. The invention as defined in claim 1 and wherein said bag means comprising:

an access opening means in a wall portion to enable insertion of the hand of the operator into association with the operational mechanism of the camera; and a viewing opening means in a wall portion of said bag means for receiving the rear end portion of the viewing tube of the camera.

6. The invention as defined in claim 5 and further comprising:

flap means mounted on said bag means adjacent each of said access opening means and said viewing opening means.

7. The invention as defined in claim 5 and wherein said access opening means comprising:

an elongated opening located adjacent the handle portion of the camera; and a Velcro fastening means associated with said elongated opening to enable closure of the opening.

8. The invention as defined in claim 1 and wherein said shield means having a width greater than the width of the main housing and a length greater than the length of the main camera housing.

9. The invention as defined in claim 7 and wherein said shield means having an arcuate cross-sectional configuration.

10. The invention as defined in claim 1 and wherein said bag means having a top wall portion, a bottom wall portion, opposite side wall portions, a rear end portion and a front end portion.

11. A cover apparatus for a video camera comprising:

a shield means made of resilient flexible material and having a length and width for being positioned over and along the upper portion of a video camera in a bent semi-circular position therealong and supported thereby with a semi-circular visor portion extending forwardly from the main housing beyond the front end of the lens tube a sufficient distance to shield the front end of the lens tube;

a bag means made of flexible collapsible and expandable cloth-like material for providing a compartment of sufficient size to receive and entirely surround the video camera and said shield means;

a relatively large size openable and closable access opening means at the front end portion of said bag means for enabling insertion into and removal of the camera from said compartment and being positionable in an open position whereat the lens tube is operable to record video signals and being positionable in a closed position to limit access of moisture;

a relatively small size openable and closable access opening means at a rear end portion of said bag means for receiving the rear end portion of the viewing tube in an open position during operation of the camera and for covering the rear end portion and of the viewing tube in a closed position; and an openable and closable hand access opening means along one side portion of said bag means for enabling insertion of the hand of the camera operator and actuating of the camera controls during operation of the camera in an open position and for covering the camera controls during operation and during storage.

* * * * *